US009878817B2

(12) United States Patent
Youell et al.

(10) Patent No.: US 9,878,817 B2
(45) Date of Patent: Jan. 30, 2018

(54) ENHANCED STRENGTH PARTITIONED CONTAINER

(71) Applicant: DRYIP, LLC, Columbus, OH (US)

(72) Inventors: D. Rudolph Youell, Dublin, OH (US); Michael Fisco, Columbus, OH (US); Aaron Spencer, Grove City, OH (US)

(73) Assignee: DRYIP, LLC, Dublin, OH (US)

( * ) Notice: Subject to any disclaimer, the term of this patent is extended or adjusted under 35 U.S.C. 154(b) by 0 days.

(21) Appl. No.: 14/971,097

(22) Filed: Dec. 16, 2015

(65) Prior Publication Data

US 2016/0185482 A1 Jun. 30, 2016

Related U.S. Application Data

(60) Provisional application No. 62/096,723, filed on Dec. 24, 2014.

(51) Int. Cl.

| | |
|---|---|
| ***B65D 5/495*** | (2006.01) |
| ***B65D 5/49*** | (2006.01) |
| ***B65D 5/32*** | (2006.01) |
| ***B65D 5/36*** | (2006.01) |

(52) U.S. Cl.

CPC ..... *B65D 5/48038* (2013.01); *B65D 5/32* (2013.01); *B65D 5/321* (2013.01); *B65D 5/36* (2013.01)

(58) Field of Classification Search

CPC . B65D 5/48048; B65D 5/48038; B65D 5/324
USPC ..... 229/120.31, 120.36, 120.37, 120.38, 229/122.21, 122.23, 117.13
See application file for complete search history.

(56) References Cited

U.S. PATENT DOCUMENTS

| | | | | | |
|---|---|---|---|---|---|
| 284,252 | A | * | 9/1883 | Smith | B65D 85/327 217/33 |
| 449,330 | A | | 3/1891 | Perkins | |
| 747,518 | A | * | 12/1903 | Ward | B65D 85/324 206/521.1 |
| 1,313,948 | A | * | 8/1919 | Maegly | B65D 5/48038 118/228 |
| 1,767,629 | A | | 6/1930 | Walter | |
| 2,284,385 | A | * | 5/1942 | Freshwaters | B65D 5/48 217/19 |
| 2,448,795 | A | | 9/1948 | Grecco | |
| 2,706,935 | A | | 4/1955 | Pasjack | |
| 2,709,547 | A | * | 5/1955 | Niedringhaus | B65D 19/02 108/55.3 |

(Continued)

FOREIGN PATENT DOCUMENTS

| | | | | |
|---|---|---|---|---|
| FR | 1417280 | A * | 10/1965 | B65D 5/48038 |
| WO | 2011010242 | A1 | 1/2011 | |

*Primary Examiner* — Nathan J Newhouse
*Assistant Examiner* — Phillip Schmidt
(74) *Attorney, Agent, or Firm* — Standley Law Group LLP

(57) ABSTRACT

An enhanced strength partitioned container containing a plurality of individual compartments, i.e, a crate, formed from mated slotted transverse panels and slotted longitudinal panels. A system of exterior panels surrounds the interlocking panels to form the outside of the partitioned container. Alternatively, an exterior panel with an overlapping section surrounds the interlocking panels, secures to itself, and forms the outside of the partitioned container. Portions of the slotted panels are adhered to and extend over a greater area of the exterior panel(s) to provide additional structural support. A lid and tray may complete the partitioned container.

9 Claims, 5 Drawing Sheets

(56) References Cited

U.S. PATENT DOCUMENTS

| | | | | |
|---|---|---|---|---|
| 3,880,343 | A | 4/1975 | Rockefeller | |
| 3,900,157 | A * | 8/1975 | Roth | B65D 5/0005 206/737 |
| 3,942,709 | A | 3/1976 | Gepfer | |
| 4,572,425 | A * | 2/1986 | Russell | B65D 5/10 220/671 |
| 5,004,146 | A * | 4/1991 | Thominet | B65D 5/48048 229/120.31 |
| 5,150,546 | A * | 9/1992 | Tucker | B24D 9/08 15/230 |
| 5,671,857 | A * | 9/1997 | Stromberg | B65D 1/225 206/505 |
| 5,785,239 | A | 7/1998 | Campbell, II et al. | |
| 6,196,449 | B1 | 3/2001 | Chen | |
| 6,669,082 | B1 | 12/2003 | Meyer | |
| 6,814,232 | B1 | 11/2004 | Morris et al. | |
| 7,455,214 | B2 | 11/2008 | Miller et al. | |
| 7,775,419 | B2 | 8/2010 | Bale | |
| 9,096,349 | B2 * | 8/2015 | Youell | B65D 5/48038 |
| 2003/0222129 | A1 * | 12/2003 | Williams | B65D 5/48004 229/120.31 |
| 2009/0272792 | A1 * | 11/2009 | Yang | B65D 5/321 229/120.09 |
| 2012/0223129 | A1 * | 9/2012 | Oppenheimer | B65D 5/46064 229/120.36 |

* cited by examiner

ENHANCED STRENGTH PARTITIONED CONTAINER

CROSS-REFERENCE TO RELATED APPLICATION

This application claims priority to provisional application 62/096,723 filed on Dec. 24, 2014 and is incorporated by reference in its entirety as if fully recited herein.

TECHNICAL FIELD

Exemplary embodiments of the present invention relate to a storage container and assembly with multiple partitions.

BACKGROUND

The present disclosure relates generally to paperboard containers, and more particularly to enhanced strength partitioned containers. Existing divider systems are primarily configured for providing internal dividers within the box container perimeter. The dividers may be formed of interlocking sheets. The interlocking sheets commonly comprise interior divided cells, and perimeter cells that are open around the perimeter of the divider. Alternatively, interlocking divider partitions do not delineate a complete perimeter cell, but provide for an abbreviated perimeter cell that functions as an air cell around the perimeter of the divider.

These perimeter air cells result in a waste of a significant portion of the box container volume, and add weight to the divider system that does not provide for additional item cells. In addition, heavy items carried in the interior cells may shift and collapse the perimeter air cells, allowing additional shifting of the contents of the box container. Shifting can cause impact damage or lead to the collapse of a stack of box containers.

As box containers are frequently stacked and subjected to exterior forces during shipment and handling, a high level of structural strength is desired to withstand stacking and rough handling. Further, many of these containers have partition sections that divide the interior of the box container but provide little to no structural strength.

In view of the foregoing, it is apparent that alternatives to the interlocking divider systems known in the art that result in greater stacking strength and resistance to rough handling would improve efficiency in the shipping and manufacturing industries.

SUMMARY OF THE INVENTIVE CONCEPT

A partitioned container contains a plurality of individual compartments. The partitioned container may include a series of substantially parallel transverse panels. Each transverse panel having a partitioning section and two folding tab sections, said folding tab sections extend from each side of the partitioning section, respectively, and share a common side and bottom edge with the partitioning section. The partitioning sections have at least one slot extending from the bottom edge of each transverse panel upwardly. Each folding tab section may extend beyond the top edge of the partition section, thereby defining a separate top edge, and is configured to be folded along the side edge shared with the partitioning section. The partitioned container also includes a series of substantially parallel longitudinal panels. Each longitudinal panel also has a partitioning section and two folding tab sections, said folding tab sections each extending from either side of the partitioning section, respectively, and share a common side and bottom edge with the partitioning section. The partitioning sections having at least one slot extending from the top edge of each longitudinal panel downwardly. Each folding tab section may extend beyond the top edge of the partition section, thereby defining a separate top edge, and is configured to be folded along the side edge shared with the partitioning section.

The transverse panels and the longitudinal panels are perpendicularly disposed with the transverse panel slots being placed within the longitudinal panel slots to create a crate of individual compartments. The number of slots in each of the transverse and longitudinal panels may be varied depending on the number of interior partitions desired. The partitioned container also has at least one exterior panel. Embodiments of the exterior panel have a top edge, a bottom edge, and a pair of side edges. The exterior panels may have a tab and recess at one side edge and a mating tab and recess on the opposite side edge. Other embodiments of the exterior panel may have tabs at one edge and mating recesses corresponding to the tabs on the opposite edge. Still other embodiments of the exterior panels may have one or more tabs on one side edge that overlap a portion of the opposite edge when such an exterior panel is mated with a corresponding exterior panel to form the outer panels of a partitioned container assembly. Each panel has at least 1 vertical fold line. The exterior panels surround the assembly thereby forming an outside surface of the partitioned container. Each transverse panel folding tab section and each longitudinal panel folding tab section is secured to the exterior panels and the exterior panel tabs and recesses are mated. When thus secured, the tab sections, which as described previously herein, may extend beyond the top edge of the partition section. This extended tab portion, being secured to the exterior panels, contributes to the strength of the formed partition container, particularly in regard to compressive forces applied to the top and bottom edges of the exterior panels. As the partitioned containers may be stacked during use, this contributed strength may result in improved performance over partitioned containers without extended tab portions. In certain embodiments, the partitioned container may be completed by adding a lid and a bottom tray to create a partial or complete enclosure of the partitions formed within the container.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

The disclosed partitioned container assembly is useful in shipping individual component parts in individual compartments so as to prevent damage to the component parts, for example, by parts bumping against each other during shipment. The disclosed partitioned container assembly can be shipped in a relatively flat, folded down configuration and then unfolded for insertion of component parts. The entire volume of the partitioned container may be used for storing component parts inasmuch as compartments fill the entire interior volume of the partitioned container. The disclosed partitioned container assembly contains folded tabs that provide additional structural strength, which is particularly helpful when stacking.

Figure 1:
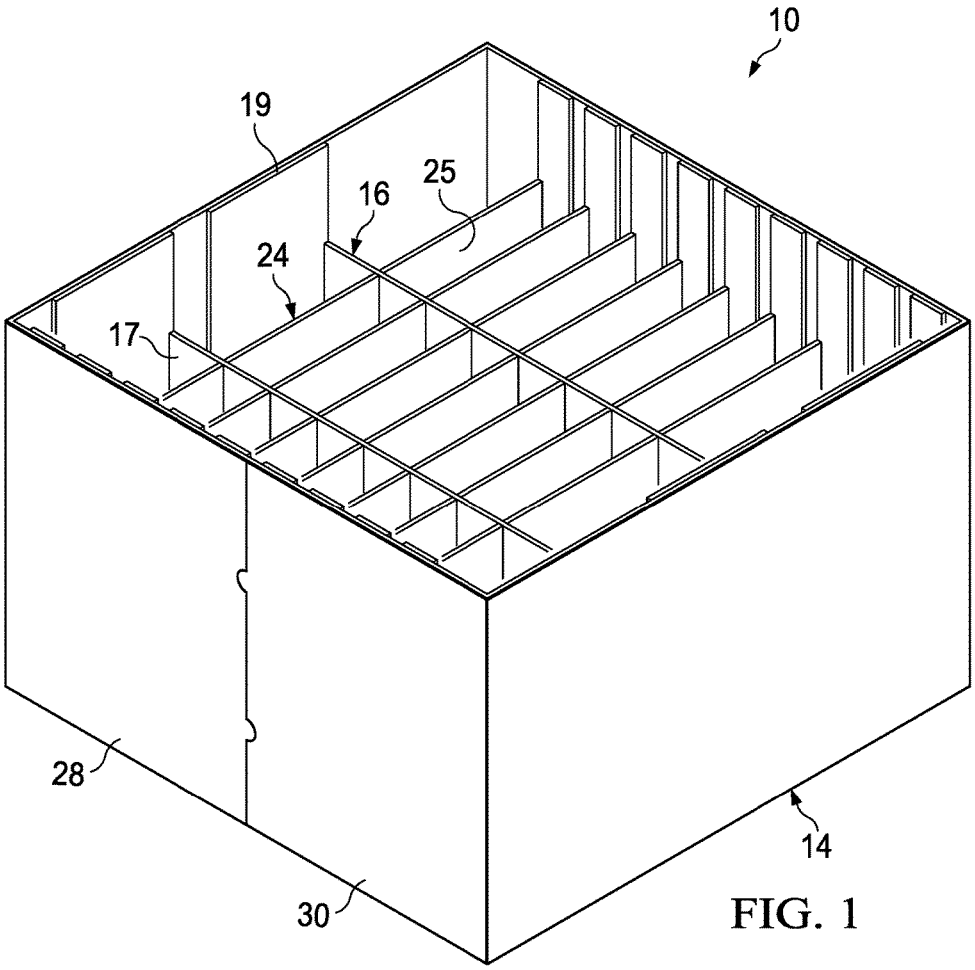
FIG. 1 is an isometric view of a disclosed partitioned container assembly.

Referring initially to FIG. 1, each partitioned container 14 is seen to have 27 individual compartments for stuffing with the same or different component parts for shipment. Such number of compartments is by way of illustration and not limitation.

Figure 2:
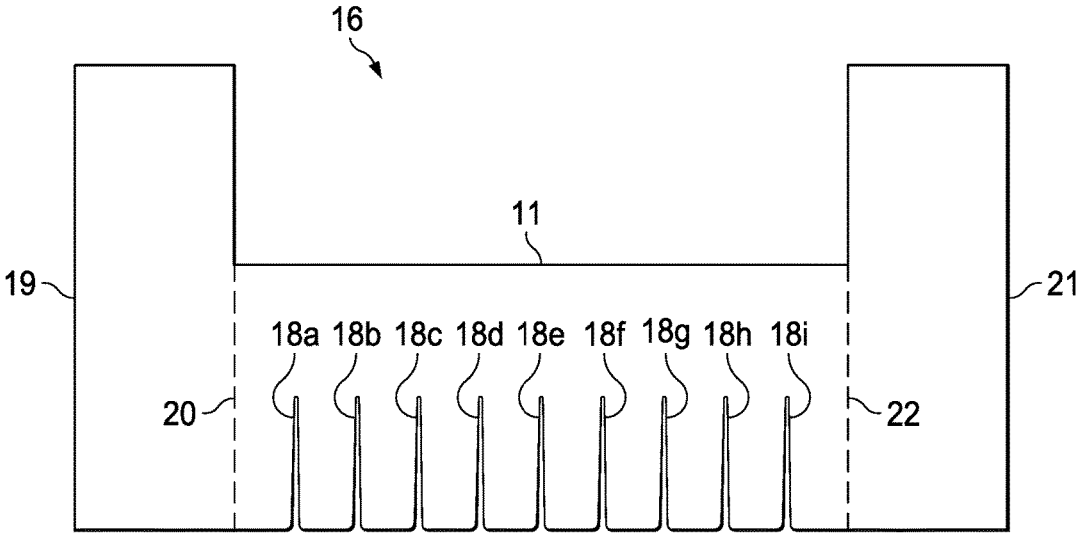
FIG. 2 is a plan view of a transverse panel according to an embodiment of the invention.
Figure 3:
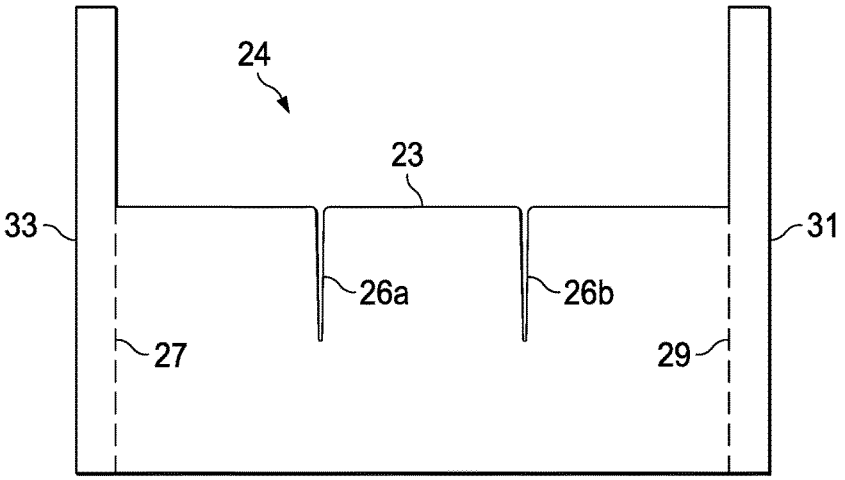
FIG. 3 is a plan view of a longitudinal panel according to an embodiment of the invention.

Referring to FIGS. 2 and 3, each partitioned container 14 is formed by a series of transverse panels, indicated generally at 16 (FIG. 2) and longitudinal panels, indicated generally at 24 (FIG. 3). The transverse panels each have a partitioning section 11 and a pair of folded tab sections 19 and 21 located at opposite sides of the partitioning section 11. The partitioning section 11 further comprises a series of slots, 18*a*-18*i*, extending from the bottom of panel 16 upwardly to about the midpoint of the height thereof. Fold lines, 20 and 22, run along the edge shared by the partitioning section 11 and the folded tab sections 19 and 21, from top to bottom of the partitioning section 11 forming the side edges of folded tabs, 19 and 21, respectively.

A longitudinal panel, indicated generally at 24, (FIG. 3) has a partitioning section 23 and folding tab sections 31 and 33 extending from opposite sides of the partitioning section 23. The partitioning section 23 further comprises a series of downwardly projecting slots, 26*a*-26*b*, extending from the top edge of partitioning section 23 to about its midpoint. The number of slots 18*a*-18*i* and 26*a*-26*b* could be in greater or fewer number than that shown in the drawings. Importantly, however, slots 18*a*-18*i* and 26*a*-26*b* are configured to cooperate for mutual insertion when panel slots 18*a*-18*i* and 26*a*-26*b* are placed at substantially right angles to each other to form the individual compartments shown for partitioned container 14. The number of individual compartments for each partitioned container also is a matter of choice and can be fewer or greater than that shown in the drawings.

Figure 4:
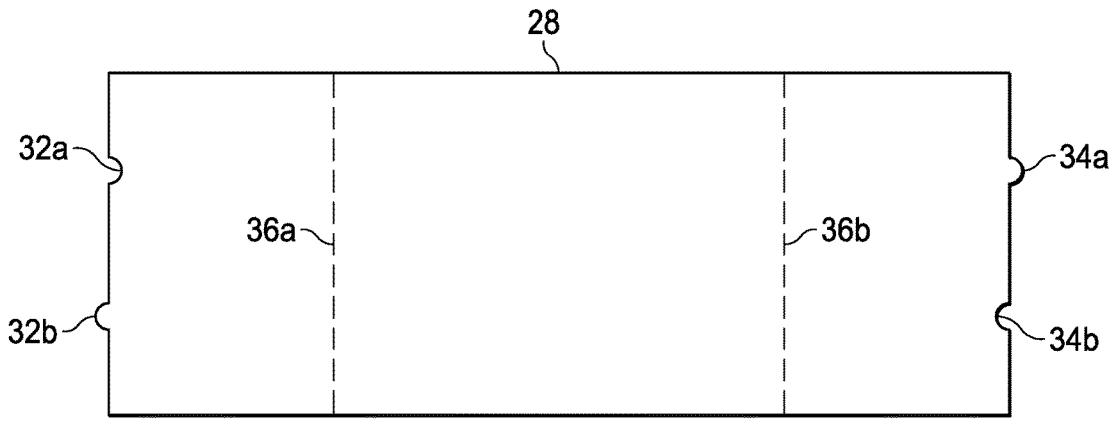
FIG. 4 is a plan view of an exterior panel according to an embodiment of the invention.
Figure 5:
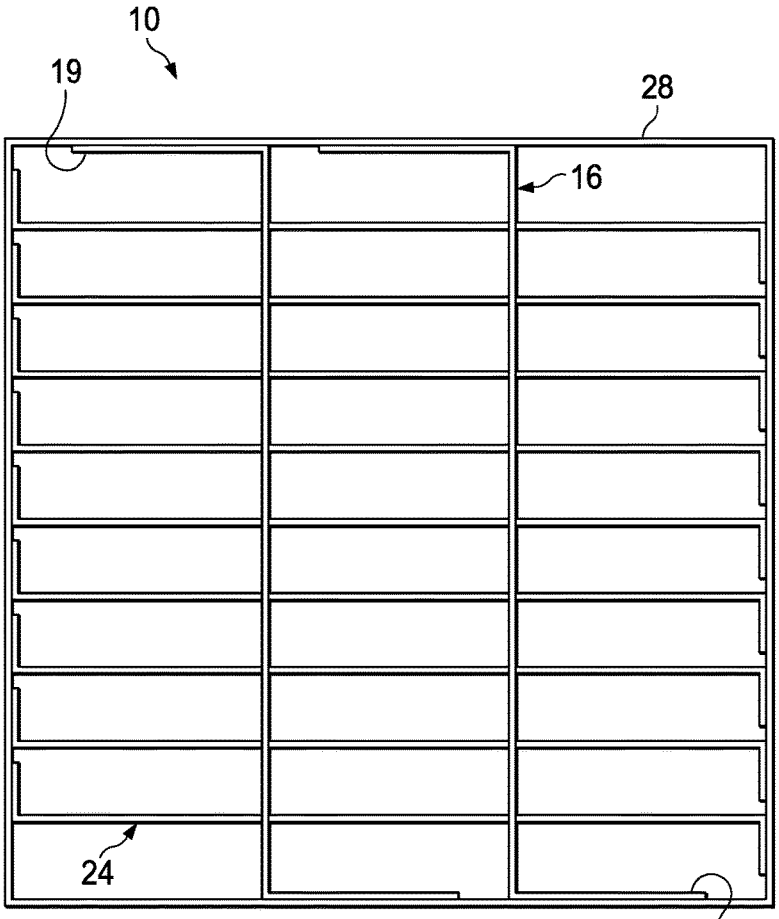
FIG. 5 is a top view of a partitioned container assembly of FIG. 1.

Referring additionally to FIG. 5, panels 16 and 24 are seen in position forming individual compartments. Surrounding the series of panels and forming the outside of the disclosed partitioned container is a pair of exterior panels, typified by panel 28 as illustrated in FIG. 4. As is shown, panel 28 has a set of tabs and recesses, 32*a* and 32*b*, on one end and a mating set of tabs and recesses, 34*a* and 34*b* respectively, on the other end. The panel also has a pair of fold lines, 36*a* and 36*b*, running from top to bottom of the panel, the distance therebetween determining the lateral dimensions of each partitioned container.

Tabs and recesses of panel 28 may be placed in mating relationship and affixed to the folding tab section of a transverse panel or longitudinal panel such as folding tab section 19, such as by adhesive, tape, bands, or other securing mechanism. Depending on the number of compartments desired, a plurality of panel 28's may be required to form the outside of the partitioned container. In such an embodiment, the number of fold lines for panel 28 will be adjusted accordingly. For example, in an embodiment using four panels to form a partitioned container, each panel may be formed with a single fold line. The combination of exterior panel 28's is configured to surround the entire exterior of the assembly as is illustrated in FIG. 5.

Each transverse and longitudinal panel 16 and 24 may have the folded tab sections therein folded to be adhered to exterior panel 28 by adhesive, tape, or other securing mechanism. The process, then, may be repeated for forming all of the compartments and outside of each partitioned container.

Figure 6:
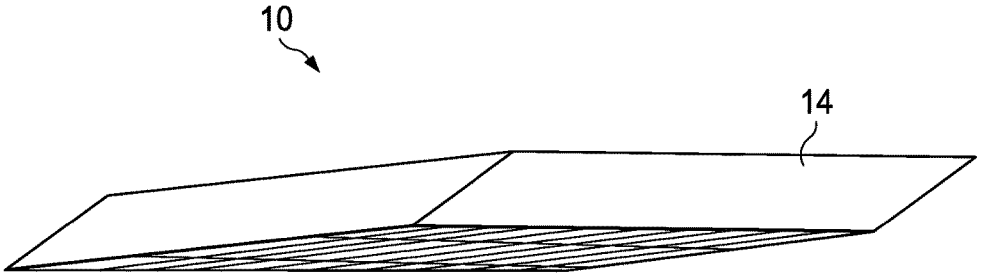
FIG. 6 is an isometric view of the partitioned container of FIG. 1 starting to be folded into a substantially flat state.
Figure 7:
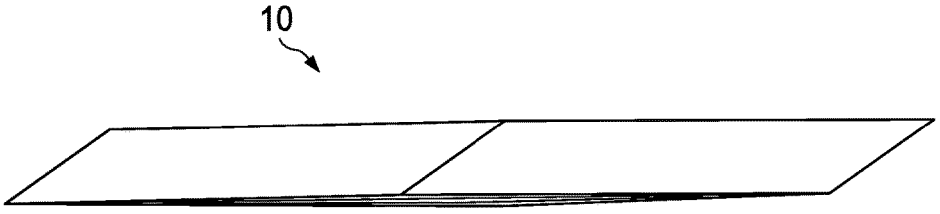
FIG. 7 is an isometric view of the partitioned container assembly of FIG. 6 almost completely folded into a substantially flat state.

The disclosed partitioned containers are configured such that it may be folded substantially flat for shipment. For example, from the place of manufacture of a partitioned container to a location where the container is filled with component parts for storage or shipment. Referring now to FIGS. 6 and 7, a partitioned container 14 may be folded, as seen in FIG. 6. Such folding is continued until the partitioned container is flat, as seen in FIG. 7. This flattened configuration may reduce cost as a result of requiring less space while being transported in an empty state.

Upon reaching a location where the container is to be used, the process shown in FIGS. 6-7 is reversed until the configuration shown in FIG. 5 is reached. A lid/base may be placed under each partitioned container to form a base and atop each partitioned container to form a lid. Each lid/base may be affixed by adhesive, tape, metal slats, or the like for retaining the component parts securely in each partitioned container.

Figure 8:
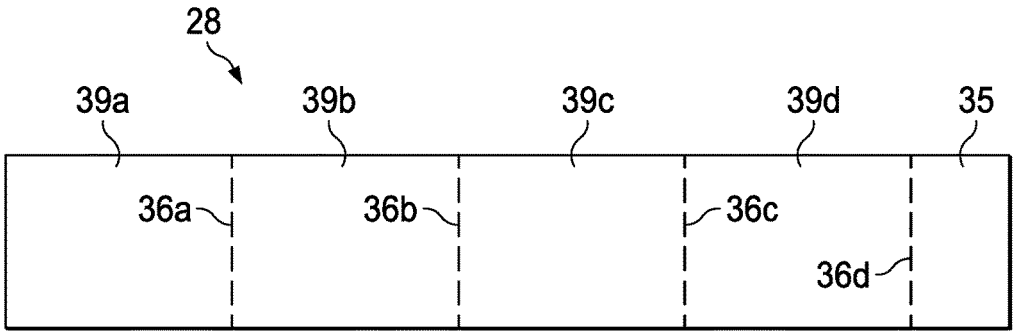
FIG. 8 is a plan view of an exterior panel according to an embodiment of the invention.

Referring now additionally to FIG. 8, an alternative embodiment of an exterior panel is illustrated. In this embodiment, a single exterior panel 28 may define the exterior of the assembly. The example exterior panel illustrated does not contain the tabs and recesses of FIG. 4, but instead comprises an additional overlap panel 35 and fold lines 36*a*-*d*. The illustrated exterior panel is divided into exterior panel sections 39*a*-*d* defined by fold lines 36*a*-*d*. The exterior panel is configured such that it folds along fold lines 36*a*-*d* into a rectangular shape, thereby encompassing the partition assembly, with the overlapping panel extending beyond the assembly such that it may be folded along fold line 36*d* to overlap a portion of the exterior panel and be secured thereto, such as by adhesive, tape, bands, or other securing mechanism. In a manner similar to that used with the exterior panel shown in FIG. 4, the folding tabs of a partition section, such as 19, 21, 31, and 32, are secured to the interior of the exterior panel, such as by adhesive, tape, bands, or other securing mechanism.

Figure 9:
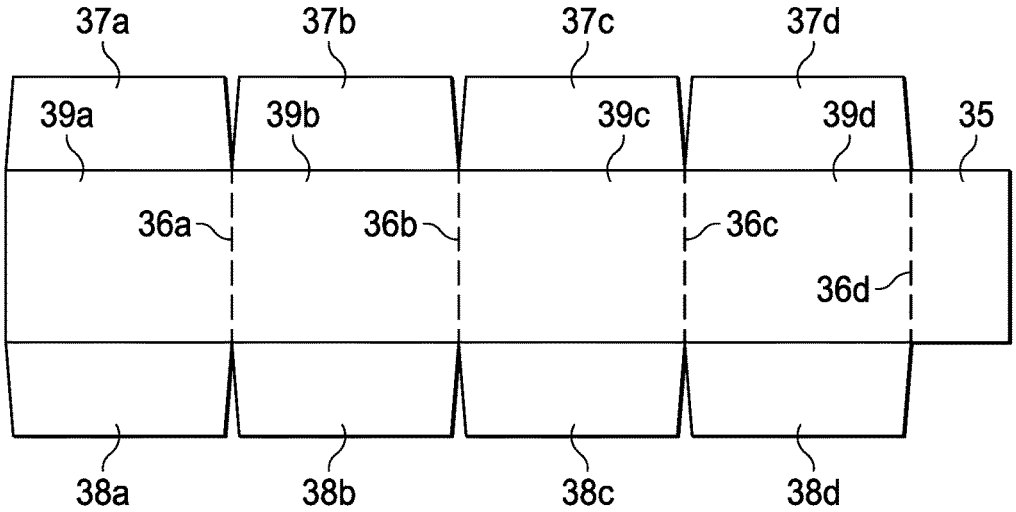
FIG. 9 is a plan view of an exterior panel according to an embodiment of the invention.

Referring to FIG. 9, the exterior panel may further comprise a series of top panels 37*a*-*d* and a series of bottom panels 38*a*-*d*. Other embodiments may comprise bottom panels 38*a*-*d* without top panels. Said panels extend one from the top and one from the bottom of each section of the exterior panel 39*a*-*d*, respectively. For example, top panel 37*a* extends from the top edge of exterior section panel 39*a*, and bottom panel 38*a* extends from the bottom edge of exterior panel section 39*a*. Said exterior section panels 39*a*-*d* are further defined by fold lines extending along the edge shared between the top panels 37*a*-*d* and the adjoining exterior panel sections 39*a-d* and the bottom panels 38*a-d* and the adjoining exterior panel sections 39*a-d*. These top and bottom panels, 37*a-d* and 38*a-d* respectively, are configured such that they may be folded and secured to one another to form the top and bottom of a partitioned container assembly. In one embodiment, the panels are configured such that when folded, they substantially cover the entirety of the top and bottom of the assembly, respectively. Said panels may be secured to one another, such as by adhesive, tape, bands, or other securing mechanism. In an alternative embodiment of the present invention, these panels may be configured such that when folded they overlap. Said panels may be secured to one another by overlapping the panels in such a way that one panel rests on top of an adjoining panel and below the other adjoining panel. In a manner similar to the exterior panels illustrated in FIG. 4, the folding tabs of partition sections, such as 19, 21, 31, and 32, may be secured to the interior of the exterior panel, such as by adhesive, tape, bands, or other securing mechanism.

Figure 10:
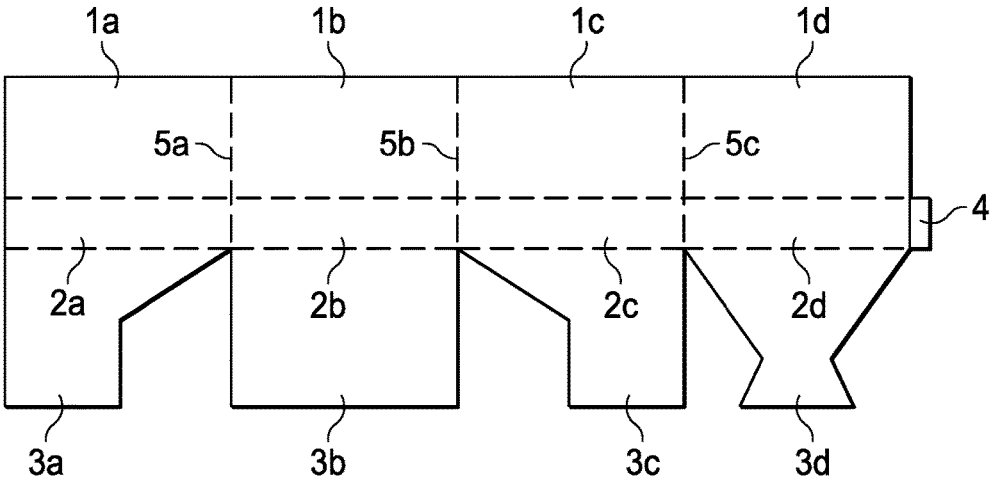
FIG. 10 is a plan view of an exterior panel according to an embodiment of the invention.

Another embodiment of an exterior panel is illustrated in FIG. 10. As is shown, an exterior panel may be formed with side panels 2*a-d*. In the illustrated embodiment, a series of bottom panels are illustrated 3*a-d*. As may be observed from the illustration, these bottom panels may be configured such that they may interlock mechanically without the need for fasteners or adhesives. Further illustrated are fold lines 5*a-c* that may extend along the side panels 2*a-d*. As illustrated, the fold lines may be cut such that top panels 1*a-d* are formed. The resulting exterior panel may be folded to form a top and bottom over a partitioned section of an enclosure to prevent loss of damage to components inserted into the partition sections enclosed by the exterior panels. The use of the illustrated exterior panel may result in a partitioned container with a bottom panel that may be disassembled such that the partitioned container may be foldable is shown in FIGS. 6 and 7 despite having had a bottom panel prior to the folding. For example, a bottom panel formed using the side panel illustrated in FIG. 9 may not allow for disassembly without damage to the bottom panels after the bottom panels have been secured using tape, staples, or adhesive.

Materials of construction for forming the partitioned containers may be a paperboard or corrugated material, such as, for example, cardboard, pasteboard, fiberboard, corrugated plastic sheets, or the like. However, other recyclable material having the necessary strength and rigidity for the particular application envisioned may be suitable. It will be appreciated that the wall construction thereof, i.e., single-ply, double-ply, or higher, may be varied depending upon the application. The partitioned containers and partitioned container assemblies will be described in particular reference to the use of corrugated paperboard; however, such description is illustrative and not a limitation on the present disclosure.

As is illustrated in FIGS. 1 and 5, in an embodiment of the invention, the folded tab sections 19, 21, 31, and 33 may be configured to extend along substantially the entire portion of the exterior panel 28 that forms a wall of a partition 17 formed by a first longitudinal panel and a second longitudinal panel or a wall of a partition 25 formed by a first transverse panel and a second transverse panel. In addition, folded tabs may extend along that portion of an exterior panel 28 forming a wall of a partition between an exterior panel and a longitudinal panel or a transverse panel. When secured by adhesive, tape, or other securing mechanism, these tabs serve to add strength to the partition assembly 10.

As is illustrated in FIG. 1 at 17 and 25, the tabs the partition sections 16 and 24 extend beyond the top edge of a respective partition section and may be secured to the exterior panels 28 and 30. These extensions serve to add rigidity and strength to the side panel portion of the exterior panels. Depending upon the intended application, the height of the side panels relative to the longitudinal and transverse panels used to form the partition sections may vary to allow the side panels to extend above or below the partition section. For example, in one embodiment, the side panels may be arranged such that their upper and lower edges align with the upper and lower edges in the longitudinal and transverse panels used to form the partition portion of the assembly. In another example embodiment, the side panels may extend above the partition portion as is illustrated in FIG. 1. Such embodiments may allow a part contained in a partition to be more easily accessible to a worker or machine attempting to remove a part for installation or use. Certain embodiments of the invention may configure the partition portions of the longitudinal and transverse panels to have cutout sections which may also serve to allow a worker or machine to more easily access a part located within a partition.

Test results show superior performance of the present invention when compared to prior art designs. In one test a partitioned container made in accordance with the present invention having substantially full coverage of the tabs (see for example at 19 in FIG. 5) did not collapse until 1337.3 pounds were applied to the top of the container. The similar testing performed on another container of the same design and same size did not collapse until 1454.9 pounds were applied. The same test run on a prior art container which was not configured to have full coverage of the folds but rather had only about half coverage of the folds collapsed at just 479.9 pounds applied.

While the partitioned containers have been described with reference to various embodiments, those skilled in the art will understand that various changes may be made and equivalents may be substituted for elements thereof without departing from the scope and essence of the disclosure. In addition, many modifications may be made to adapt a particular situation or material to the teachings of the disclosure without departing from the essential scope thereof. Therefore, it is intended that the partitioned container not be limited to the particular embodiments disclosed. All citations referred herein are expressly incorporated herein by reference.

While certain embodiments of the present invention are described in detail above, the scope of the invention is not to be considered limited by such disclosure, and modifications are possible without departing from the spirit of the invention as evidenced by the following claims:

What is claimed is:

1. A partitioned container assembly containing a plurality of individual compartments the partitioned container assembly comprising:

(a) a subassembly comprising:

(i) at least one transverse panel, substantially parallel to a second transverse panel, each transverse panel further comprising a partitioning section; a transverse folded tab section extending from each side of the partitioning section, each said transverse folded tab section having an upper edge that extends beyond an upper edge of the partitioning section to form a separate top edge; a fold line located on each edge shared by the partitioning section and a transverse folded tab section, each said fold line running the length of the shared edge; the partitioning section comprising a series of slots extending upwardly from the bottom edge of the partitioning section to about the midpoint of the height thereof;

(ii) at least one longitudinal panel, substantially parallel to a second longitudinal panel, each longitudinal panel further comprising a partitioning section, a longitudinal folded tab section having an upper edge that extends beyond an upper edge of the partitioning section to form a separate top edge; the longitudinal folded tab sections extending from each side of the partitioning section; a fold line located on each edge shared by the partitioning section and a longitudinal folded tab section, each said fold line running the length of the shared edge; the partitioning section comprising a series of slots extending downwardly from the top edge of the partitioning section to about the midpoint of the height thereof; said transverse panels and said longitudinal panels being perpendicularly disposed with each said transverse panel slot being placed within a corresponding longitudinal panel slot to create a series of individual compartments; and (b) at least two exterior panels, each exterior panel being defined by a top edge, a bottom edge, and a pair of side edges; the exterior panel having at least 1 vertical fold line; wherein said transverse folded tab sections of the transverse panel and the longitudinal folded tab sections of the longitudinal panel are configured to extend vertically substantially the distance from the bottom edge of the exterior panel to the top edge of the exterior panel resulting in an uncompartmentalized space formed between the top edge of the partitioning sections of the transverse and longitudinal panels and below the top edge of the exterior panels; and wherein said transverse folded tab sections of the transverse panel and the longitudinal folded tab sections of the longitudinal panel are configured to extend horizontally along the exterior panel substantially a horizontal distance formed by a said individual compartment; and wherein said exterior panels comprise at least one tab and at least one recess at one side edge and corresponding mating tabs and recesses on the opposite side edge; said exterior panel tabs and recesses being mated.

2. The partitioned container assembly of claim 1, wherein said mated panel tabs and recesses of said exterior panels are adhesively joined to one of the transverse panel fold tabs.

3. The partitioned container assembly of claim 1, where said exterior panels are configured to surround said subassembly to form the outside surface of said assembly.

4. The partitioned container assembly of claim 1, where each transverse folded tab section of each transverse panel and each longitudinal folded tab sections of the longitudinal panel are adhesively joined to one of said exterior panels.

5. The partitioned container assembly of claim 1, formed from corrugate stock.

6. The partitioned container assembly of claim 1, wherein the transverse and longitudinal panels are arranged to enable the assembly to be folded substantially flat.

7. The partitioned container assembly of claim 1, additionally comprising at least one cutout section formed along the top edge of at least one longitudinal panel.

8. The partitioned container assembly of claim 1, additionally comprising a bottom tray.

9. The partitioned container assembly of claim 8, additionally comprising a lid.

* * * * *